US005284365A

United States Patent [19]

Stuart

[11] Patent Number: 5,284,365

[45] Date of Patent: Feb. 8, 1994

[54] GREETING CARD ASSEMBLY

[75] Inventor: James H. Stuart, Pueblo, Colo.

[73] Assignee: Sangray Corporation, Pueblo, Colo.

[21] Appl. No.: 885,538

[22] Filed: May 19, 1992

[51] Int. Cl.[5] ..... B12D 15/00

[52] U.S. Cl. ..... 283/117; 446/147

[58] Field of Search ..... 283/117; 446/147, 148, 446/149; 40/158.1, 124.4

[56] References Cited

U.S. PATENT DOCUMENTS

| | | | |
|---|---|---|---|
| 4,200,222 | 4/1980 | Feuer | 40/158.1 |
| 4,439,941 | 4/1984 | Halperin | 446/147 |
| 5,120,090 | 6/1992 | Reinl | 446/147 X |

*Primary Examiner*—Mark Rosenbaum
*Assistant Examiner*—Willmon Fridie, Jr.
*Attorney, Agent, or Firm*—Phillip A. Rein

[57] ABSTRACT

A greeting card assembly including a basic greeting card member with a removable message insert assembly connected thereto. The basic greeting card member is provided with an insert mounting opening and insert anchor tabs which are connected to the removable message insert assembly. The removable message insert assembly includes a primary message insert member and an insert support assembly operable for connection to each other having the insert anchor tabs clamped and secured therebetween. The insert anchor tabs are operable to be severed to remove the removable message insert assembly from the basic greeting card member. The primary message insert member is connected to a cylindrical support member constructed of a magnetic material for ready attachment to an exterior surface of a refrigerator or other magnetically compatible surfaces. In a second embodiment, the removable message insert assembly is provided with a primary message insert member mounted on each side of the cylindrical support member which can be removed from the basic greeting card member to be used as a Christmas tree ornament or the like.

28 Claims, 2 Drawing Sheets

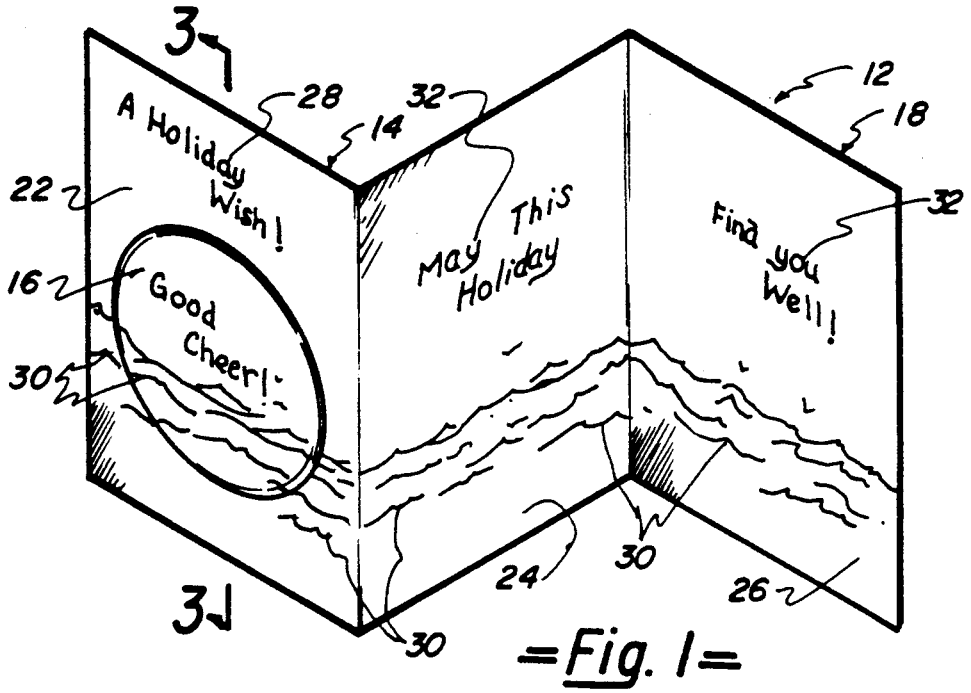
=Fig. 1=
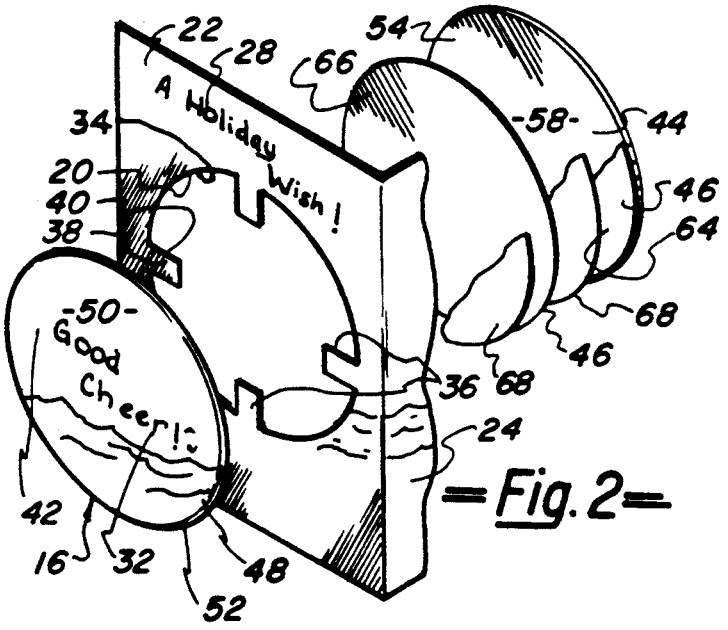
=Fig. 2=
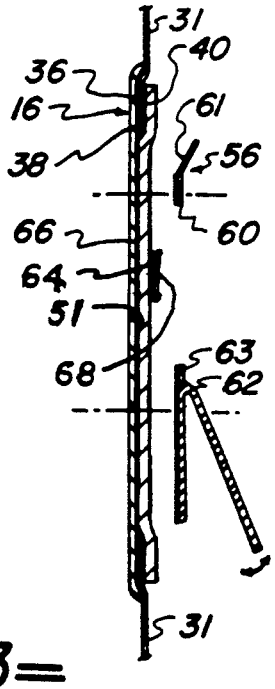
=Fig. 3=

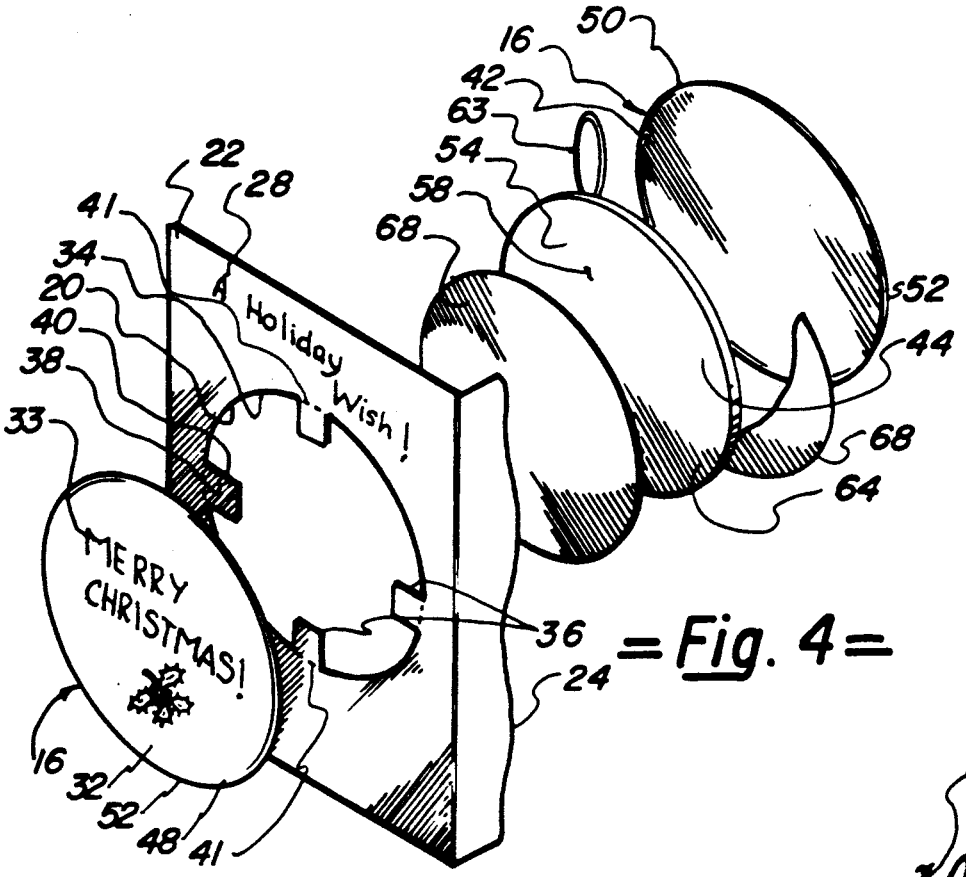
= Fig. 4 =
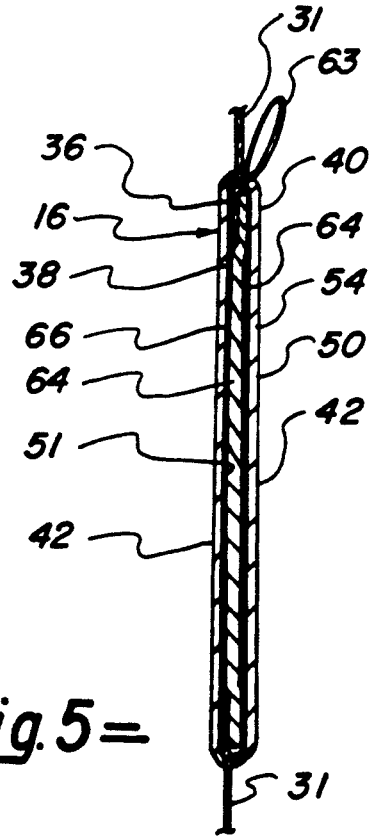
= Fig. 5 =

GREETING CARD ASSEMBLY

PRIOR ART

A patent search was not conducted on this invention.

PREFERRED EMBODIMENT OF THE INVENTION

In one preferred embodiment of this invention, a greeting card assembly is provided having a basic greeting card member with a removable message insert assembly connected thereto. The basic greeting card member is constructed of a firm sheet paper material and includes foldable card sections with an insert mounting opening in one of the foldable card sections.

The foldable card sections are provided with 1) a first card portion having the insert mounting opening therein; 2) a second card portion having one side wall edge integral with a side wall edge of the first card portion; and 3) a third card portion having one side wall edge integral with an opposite side wall edge of the second card portion.

The first card portion has card purpose indicia in conjunction with artistic indicia on a front surface and instruction indicia on a back side thereof.

The second card portion is provided with card message indicia and a continuation of the artistic indicia present on the first card portion.

The third card portion includes the card message indicia and artistic indicia which is a continuation of the artistic indicia on the first and second card portions.

The insert mounting opening includes a mounting cut-out opening or circle which is interrupted by insert anchor tabs having a plurality, namely four, thereof. Each anchor insert tab is extended inwardly from a diameter of the cut-out opening and having an outer surface and an inner surface. Each anchor insert tab is of generally rectangular shape and formed from the sheet paper material of the first card portion.

The removable message insert assembly includes 1) a primary message insert member; 2) an insert support assembly; and 3) a connector assembly for attaching the insert support assembly to the first card portion and the primary message insert member.

The primary message insert member includes a main support body having an outer message surface and an inclined flange section about an outer periphery thereof.

The outer message surface is provided with card message indicia and artistic indicia. The artistic indicia is compatible or in continuity with the artistic indicia on the first card portion. Preferably, the artistic indicia throughout the foldable card sections and the primary message insert member are of a common ongoing design theme such as ocean and mountain scenery, lakes and mountain scenery, or the like.

The inclined flange section operates to provide a smooth transitional flow from the artistic indicia on the primary message insert member to the adjacent artistic indicia on the first card portion.

The insert support assembly includes a cylindrical support member of a sheet material operable to receive a connector member thereon. The cylindrical support member is preferably constructed of a magnetic material so as to be attachable by magnetic forces to an exterior surface of a refrigerator door or other magnetic receptive surfaces.

The connector member can be 1) a picture hanger member operable to receive a picture hanger nail or the like therethrough for hanging on a wall; 2) an inclined vertical support member for supporting on a horizontal surface; 3) the magnetic material described above; or 4) an adhesive layer on a back surface of the cylindrical support member.

The vertical support member is secured to the cylindrical support member and foldable outwardly to rest an anchor portion on a the horizontal surface.

In another embodiment, the removable message insert assembly includes a pair of the primary message insert members mounted on each opposite side of the insert support assembly and having a connector member, such as an elastic loop, secured thereto. The primary message insert members have outer artistic indicia to resemble a Christmas ornament or the like whereby the removable message insert assembly can be removed from the basic greeting card member and hung on a Christmas tree by an ornament hook connected to the elastic loop.

The connector member is various means for supporting the removable message insert assembly after being removed from the basic greeting card member.

The connector assembly consists of two embodiments for attaching the insert support assembly to the primary message insert member and the insert anchor tabs in the insert mounting opening. In one embodiment, the connector assembly could be an adhesive layer applied directly to an outer surface of the cylindrical support member and protected by a removable cover member before a final assembly step.

In a second embodiment, the connector assembly consists of an adhesive sheet having the removable cover members on both sides thereof which are removed during a final assembly step.

OBJECTS OF THE INVENTION

One object of this invention is to provide a greeting card assembly including a basic greeting card member with a message insert assembly releasably connected thereto and being readily removable for attachment or support on a vertical or horizontal surface.

Another object of this invention is to provide a greeting card assembly including a basic greeting card member having a removable message insert assembly connected thereto and artistic indicia which is continuous across the greeting card assembly and having means for detaching the removable message insert assembly for mounting on a metallic surface through a magnetic cylindrical support member.

One other object of this invention is to provide a greeting card assembly including a basic greeting card member with a first card portion having an insert mounting opening for attachment of a removable message insert assembly which is firmly secured thereto but readily removed on severing of insert anchor tabs for subsequent attachment to a wall or support on a horizontal support surface or through a magnetic support member to a refrigerator or similar magnetically compatible surfaces.

One further object of this invention is to provide a greeting card assembly including a basic greeting card assembly having a removable message insert assembly with artistic indicia on both sides thereof so as to be mountable on a Christmas tree as an ornament.

Still, another object of this invention is to provide a greeting card assembly including 1) a removable message insert assembly that is attractive in appearance;

continuous artistic indicia revealed on unfurling of basic card sections; 3) features of multiple uses; and 4) means to easily remove the removable message insert assembly for continued use and display of this novel insert member.

Various other objects, advantages, and features of the invention will become apparent to those skilled in the art from the following discussion, taken in conjunction with the accompanying drawings, in which:

FIGURES OF THE INVENTION

FIG. 1 is a perspective view of a greeting card assembly of this invention in an open or unfolded condition;

FIG. 2 is an exploded perspective view of a portion of a basic greeting card member and a removable message insert assembly forming the greeting card assembly of this invention;

FIG. 3 is an enlarged fragmentary sectional view taken along line 3—3 in FIG. 1.

FIG. 4 is a perspective view of a second embodiment of a greeting card assembly of this invention; and FIG. 5 is an enlarged fragmentary sectional view of the second embodiment similar to FIG. 3.

The following is a discussion and description of preferred specific embodiments of the greeting card assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a greeting card assembly of this invention, indicated generally at 12, includes a basic greeting card member 14 having a removable message insert assembly 16 connected thereto. The basic greeting card 14 is preferably constructed of a rigid paper card stock material normally used in greeting and Christmas card assemblies.

The basic greeting card member 14 is illustrated as constructed of foldable card sections 18 having an insert mounting opening 20 in one portion thereof.

The foldable card sections 18 include 1) a first card portion 22 which is initially visible on removing the basic greeting card member 14 from an envelope; 2) a second card portion 24 integral along one side wall edge with a similar side wall edge on the first card portion 22; and 3) a third card portion 26 integral along one side wall edge with an opposite side wall edge of the second card portion 24.

The first card portion 22 has card purpose indicia 28 and artistic indicia 30 on an outer surface thereof. The card purpose indicia 28 indicates the card's purpose and function such as a birthday greeting, a get well message, holiday messages, or the like. The first card portion 22 has instruction indicia 31 on a back or inner surface as indicated in FIG. 3. The instruction indicia 31 would have the term "Cut here" and point to areas to be severed in order to remove the removable message insert assembly 16 in a manner to be explained. Additionally, the instruction indicia 31 would state "To remove your gift magnet, cut the four tabs at the dotted lines". The instruction indicia 31 includes a dotted line at each area of respective "tabs" to be severed.

The second card portion 24 is provided with card message indicia 32 and artistic indicia 30 which is a continuation of the artistic indicia 30 on the first card portion 22.

The third card portion 26 has card message indicia 32 and the artistic indicia 30 continuing a common artistic theme across all of the outer surfaces of the foldable card sections 18. This is an important feature of the invention in that the artistic indicia 30 is continued in a common theme throughout the outer observable areas of the foldable card sections 18 and an outer surface on the removable message insert assembly 16 as will be noted.

The insert mounting opening 20 includes a mounting cut-out opening or circle 34 interrupted in equal spacing by insert anchor tabs 36 extended inwardly of the cut-out opening 34.

The insert anchor tabs 36 are of a generally rectangular shape having an outer surface 38 and an inner surface 40 which are important for attaching the removable message insert assembly 16 to the first card portion 22 in a rigid manner while allowing the removable message insert assembly 16 to be easily removed on following the instruction indicia 31 as will be explained.

The removable message insert assembly 16 includes 1) a primary message insert member 42; 2) an insert support assembly 44 to be connected to the primary message insert member 42 and the insert anchor tabs 36; and 3) a connector assembly 46 operable to interconnect the insert support assembly 44 to the primary message insert member 42 with the insert anchor tabs 36 mounted therebetween.

The primary message insert member 42 can be constructed of a plastic or other durable material having a main message body 48 with an outer message surface 50, an inner surface 51, and a peripheral inclined flange section 52.

The outer message surface 50 has card message indicia 32 and the artistic indicia 30 similar to the artistic indicia 30 on the first card portion 22. Therefore, the primary message insert member 42 continues the continuity of the entire basic greeting card member 14 with the artistic indicia 30.

The inclined flange section 52 provides a tapered free-flowing surface onto the first card portion 22 blending the artistic indicia 30 on each to present an attractive, appealing greeting card assembly 12.

The insert support assembly 44 includes a cylindrical support member 54 which may be provided with a connector member 56 mounted thereon. The cylindrical support member 54 is of a disk or other shape conforming generally with the insert mounting opening 20 being of sheet material preferably constructed of a magnetic material 58 for magnetic attachment to metallic support surfaces such as refrigerator doors and the like.

The connector member 56 could be 1) a picture hanger member 60 connected to a rear surface of the support member 54 and having a connector hole 61 for receiving a picture hanger nail for mounting on a wall; 2) an inclined vertical support member 62 secured by an anchor portion 63 to a back surface of the support member 54; or 3) an adhesive layer 64 protected by a cover sheet 68 on a back surface of the support member 54.

The options of the connector member 56 allow the removable message insert assembly 16 to be 1) attached to a vertical support wall; 2) supported by the inclined vertical support member 62 on a horizontal table top surface; 3) connected by the magnetic material 58 to a magnetically compatible surface; or 4) by the adhesive layer 64 on removal of the cover sheet 68 to any surface.

The connector assembly 46 may be 1) the adhesive layer 64 applied directly to the cylindrical support member 54 and covered by the removable cover member 68 prior to an assembly procedure; or 2) an adhesive sheet 66 having a removable cover member 68 applied to both sides thereof which can then be removed during the assembly procedure.

In a second embodiment as noted in FIGS. 4 and 5, the greeting card assembly 12 includes the basic greeting card member 14 with the removable message insert assembly 16 connected thereto. The basic elements of the basic greeting card member 14 remain as previously described.

The removable message insert assembly 16 includes 1) the primary message insert member 42 with Christmas artistic indicia 33 on an outer surface; 2) an insert support assembly 44 to be connected to the primary message insert member 42 and the insert anchor tabs 32; 3) a connector assembly 46 operable to interconnect the insert support assembly 44 to the primary message insert member 42 with the insert anchor tabs 36 mounted therebetween; and 4) a second primary message insert member 42 having the Christmas artistic indicia 33 on an outer surface is mounted and secured against an opposite side of the insert support assembly 44.

The cylindrical support member 54 is provided with an adhesive layer 64 on each side thereof protected by a removable cover member 68. During assembly, the cover member 68 is removed and the adhesive layer 64 bonds the primary message insert member 42 to the cylindrical support member 54 as noted in FIG. 5.

In this embodiment, the connector member 56 is an elastic loop or string 63 which is connectable to a Christmas ornament hook for mounting on a Christmas tree as will be explained.

The insert anchor tabs 36 are provided with perforated edges 41 adjacent the mounting cut-out circle 34 for ease of removing the primary message insert member 42 as will be explained.

USE AND OPERATION OF THE INVENTION

In the use and operation of the greeting card assembly 12 of this invention, the basic greeting card member 14 could be of a single folded type or of a combination of foldable card sections 18 having the first, second, and third card portions 22, 24, 26. The foldable card sections 18 as described is preferred as back sides of the first card portion 22 and the primary message insert member 42 are hidden from view on unfolding the basic greeting card member 14.

The basic greeting card member 14 is first prepared by cutting an insert mounting opening 20 in one of the foldable card portions 18 and preferably, in the first card portion 22.

The insert mounting opening 20 is illustrated as a circular outline of the mounting cut-out circle 34 with the insert anchor tabs 36 extended inwardly from an outer edge of the mounting cut-out circle 34.

The insert anchor tabs 36 are illustrated as generally rectangular in shape and with four equally spaced about the mounting cut-out circle 34. However, it is acknowledged that various numbers of the insert anchor tabs 36 could be utilized with the objective to provide the necessary support to the removable message insert assembly 16 in the assembled condition while allowing ease of removal therefrom according to the instruction indicia 31.

It is noted that the insert anchor tabs 36 could vary in size, shape, and number. Further, the insert mounting opening 20 and primary message insert member 42 could be rectangular, square, or other shapes and sizes as long as compatible with each other.

On assembly of the primary message insert member 42 to the condition as noted in FIGS. 1 and 3, the primary message insert member 42 is positioned over and about the mounting cut-out circle 34. The outer diameter of the primary message insert member 42 is slightly larger than that of the mounting cut-out circle 34 so as to completely enclose same.

Next, the insert support assembly 44, being the cylindrical support member 54, is positioned adjacent to the primary message insert member 42 with the adhesive layer 64 revealed on removal of the cover member 68.

These positioned items are then pressed together in order to interconnect the cylindrical support member 54 through the adhesive layer 64 to a back surface of the main message body 48 of the primary message insert member 42. Concurrently, the adhesive layer 64 engages the inner surface 40 of the respective insert anchor tabs 36 to achieve a clamping action and interconnection as shown in FIG. 3.

In an alternate method of construction, the adhesive sheet 66 which, during the assembly process, would have the removable cover members 68 on each side removed and then sandwiched between the cylindrical support member 54 and the primary message insert member 42.

An additional step would be 1) utilization of the connector member 56 with the picture hanger member 60; 2) the inclined vertical support member 62; or 3) the adhesive layer 64 (on removal of the cover member 68) mounted on an outer exposed surface of the cylindrical support member 54.

The removable message insert assembly 16 can be readily attached through construction of a magnetic material to a refrigerator or other magnetically compatible surface; can be attached by the picture hanger member 60 and a hanger nail to a support wall; can be mounted on a horizontal surface by use of the inclined vertical support member 62; or can be attached to any surface by the adhesive layer 64.

In the second embodiment as shown in FIGS. 4 and 5, the removable message insert assembly 16 can be removed from the basic greeting card member 14 according to the instruction indicia 31. As the insert anchor tabs 36 have the respective perforated edges 41, lateral movement of the removable message insert assembly 16 would sever the perforated edges 41.

Next, a Christmas ornament hook member could be attached to the string hoop or member 63 for subsequent attachment to a limb on a Christmas tree for continued enjoyment.

It is noted that the greeting card assembly 12 of this invention serves a dual purpose of having 1) a basic greeting card member 14 with card message indicia 32 and continuous artistic indicia 30; and 2) a removable message insert assembly 16 being a magnetic button type member or hanging type Christmas tree ornament which can be removed and continue to be used past the first intended purpose and function of the greeting card assembly 12.

The greeting card assembly includes a basic foldable greeting card member with a removable message insert assembly which is providing a dual purpose and function; economical to manufacture; and easily operable to detach the removable message insert assembly for continued personal use and visual pleasure by the card recipient.

While the invention has been described in conjunction with preferred specific embodiments thereof, it will be understood this description is intended to illustrate and not to limit the scope of the invention, which is defined by the following claims:

I claim:

1. A greeting card assembly having a removable message and artistic indicia member, comprising:

a) a card section having an insert mounting opening with anchor tabs extended inwardly therefrom;

b) a removable message insert assembly including a primary message insert member and a support member;

c) said primary message insert member mounted against said card section about said insert mounting opening; and d) said support member secured to said primary message insert member and said anchor tabs to achieve said greeting card assembly;

whereby said anchor tabs may be severed to remove said removable message insert assembly from said card section for continued use and enjoyment.

2. A greeting card assembly as described in claim 1, wherein:

a) said support member is constructed of a magnetic material.

3. A greeting card assembly as described in claim 1, wherein:

a) a connector member is connected to said support member; and b) said connector member is a picture hanger member.

4. A greeting card assembly as described in claim 1, including:

a) a connector member connected to said support member; and b) said connector member is an inclined support member for support on a horizontal surface.

5. A greeting card assembly as described in claim 1, wherein:

a) a connector member connected to said support member; and b) said connector member is an adhesive layer secured to a back surface of said support member for attachment to any surface.

6. A greeting card assembly as described in claim 1, wherein:

a) said card section having artistic indicia thereon; and b) said primary message insert member having an outer surface with artistic indicia thereon compatible and continuous with said artistic indicia on said card section.

7. A greeting card assembly as described in claim 1, wherein:

a) said primary message insert member having an outer inclined flange section tapered to contact said card section to provide a continuous uninterrupted visual image with said artistic indicia on said card section and said primary message insert member.

8. A greeting card assembly having a portion thereof selectively removable for subsequent use and display, comprising:

a) a basic greeting card member having a removable message insert assembly connected thereto;

b) said basic greeting card member having an insert mounting opening with an insert anchor tab;

c) said removable message insert assembly includes a primary message insert member and an insert support assembly;

d) said primary message insert member mounted against one side of said basic greeting card member about and enclosing said insert mounting opening and against one side of said insert anchor tab; and e) said insert support assembly includes a support member mounted against and anchored to said primary message insert member and another side of said insert anchor tab;

whereby said anchor tab may be severed to remove said removable message insert assembly from said basic greeting card member for continued use and enjoyment.

9. A greeting card assembly as described in claim 8, wherein:

a) said basic greeting card member having foldable card sections being interconnected to each other and folded outwardly to reveal an elongated, continuous view thereon;

b) said foldable card sections and said primary message insert member having artistic indicia thereon; and c) said artistic indicia having a common continuous theme to provide continuity in the elongated, continuous view when in an unfolded condition.

10. A greeting card assembly as described in claim 8, wherein:

a) said basic greeting card member having a plurality of said insert anchor tabs and, in the assembled condition, said insert anchor tabs pressed against an inner surface of said primary message insert member and secured against said insert support assembly.

11. A greeting card assembly including a removable insert member having purpose, usage, and artistic indicia for continued use and enjoyment, comprising:

a) a basic greeting card member with a message insert assembly connected thereto;

b) said basic greeting card member having an insert mounting opening with anchor tabs;

c) said message insert assembly includes a primary message insert member mounted against one side of said basic greeting card member to overlay said anchor tabs;

d) an insert support assembly having a support member secured by a connector assembly against an opposite side of said basic greeting card member, said primary message insert member, and said anchor tabs; and e) a portion of said anchor tabs not covered by said support member;

whereby said portion of said anchor tabs are selectively severed to remove said message insert assembly from said basic greeting card member for subsequent continued use and enjoyment.

12. A greeting card assembly as described in claim 11, wherein:

a) said basic greeting card member having a plurality of card portions which are unfolded to reveal message indicia and a continuous artistic indicia thereacross; and b) said artistic indicia continuing from one of said card portions to another of said card portions and on an outer surface of said primary message insert member.

13. A greeting card assembly as described in claim 11, wherein:

a) said insert support assembly includes a connector member secured to said insert support assembly for support through a picture hanger member, an inclined vertical support member, or an adhesive layer for support on a horizontal or vertical surface for continued observation and visual enjoyment of said primary message insert member.

14. A greeting card assembly as described in claim 11, wherein:

a) said anchor tabs having inner and outer surfaces;

b) said outer surface of said anchor tabs engages a back surface of said primary message insert member; and c) said inner surface of said anchor tabs engages and secured to said support member;

whereby said anchor tabs may be severed to remove conjointly said removable message insert assembly for continued use and enjoyment.

15. A greeting card assembly as described in claim 11, wherein:

a) said support member is constructed of a magnetic material.

16. A greeting card assembly as described in claim 11, wherein:

a) said insert mounting opening is a mounting cut-out circle having said anchor tabs extended inwardly from said cut-out circle;

b) said primary message insert member of a diameter greater than a diameter of said cut-out circle; and c) said support member of a diameter less than said diameter of said cut-out circle to reveal said portion of said anchor tabs for severance thereof and removal of said message insert assembly.

17. A greeting card assembly as described in claim 16, wherein:

a) said basic greeting card assembly having instruction indicia to advise of steps to be taken to sever said anchor tabs for removing said message insert assembly.

18. A greeting card assembly as described in claim 1, wherein:

a) said removable message insert assembly includes another one of said primary insert members secured to another side of said support member.

19. A greeting card assembly as described in claim 18, wherein:

a) said anchor tabs each having a perforated edge for ease of severing on lateral movement of said removable message insert assembly from said card section and said insert mounting opening.

20. A greeting card assembly as described in claim 18, wherein:

a) said support member having a connector member secured thereon to receive an anchor member adapted to be connected to a Christmas tree or the like.

21. A greeting card assembly as described in claim 8, wherein:

a) said removable message insert assembly includes a second one of said primary message insert members mounted against an opposite side of said basic greeting card member about and enclosing said insert mounting opening and against an opposite side of said insert anchor tab.

22. A greeting card assembly as described in claim 11, wherein:

a) a second one of said primary message insert members mounted against an opposite side of said basic greeting card member and said support member;

b) said anchor tabs perforated for ease of removing said message insert assembly; and c) a connector member secured to said message insert assembly extended laterally of said primary message insert members operable for connection to a Christmas tree or the like for continued visual enjoyment.

23. A greeting card assembly having a removable message and artistic indicia member, comprising:

a) a card section having an insert mounting opening;

b) a removable message insert assembly including a primary message insert member and a support member;

c) said primary message insert member mounted against said card section about said insert mounting opening; and d) said support member secured to said primary message insert member through said insert mounting opening to achieve said greeting card assembly;

whereby said removable message insert assembly and said support member are removable from said card section for continued use and enjoyment.

24. A greeting card assembly as described in claim 23, wherein:

a) said support member is constructed of a magnetic material.

25. A greeting card assembly as described in claim 23, wherein:

a) said card section having artistic indicia thereon; and b) said primary message insert member having an outer surface with artistic indicia thereon compatible and continuous with said artistic indicia on said card section.

26. A greeting card assembly as described in claim 23, wherein:

a) said primary message insert member having an outer inclined flange section tapered to contact said card section to provide a continuous uninterrupted visual image with said artistic indicia on said card section and said primary message insert member.

27. A greeting card assembly as described in claim 23, wherein:

a) said removable message insert assembly includes another one of said primary message insert members secured to another side of said support member.

28. A greeting card assembly as described in claim 23, wherein:

a) said greeting card assembly having a plurality of said card sections which are unfolded to reveal message indicia and a continuous artistic indicia thereacross; and b) said artistic indicia continuing from one of said card sections to another of said card sections and on an outer surface of said primary message insert member.

* * * * *